US006608542B2

(12) United States Patent
Pietsch et al.

(10) Patent No.: US 6,608,542 B2
(45) Date of Patent: Aug. 19, 2003

(54) SWITCHING RELAY WITH IMPROVED ARMATURE SPRING

(75) Inventors: Karsten Pietsch, Berlin (DE); Thomas Haehnel, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 5 days.

(21) Appl. No.: 10/216,274

(22) Filed: Aug. 9, 2002

(65) Prior Publication Data

US 2003/0048162 A1 Mar. 13, 2003

(30) Foreign Application Priority Data

Aug. 10, 2001 (DE) ..... 101 39 433
Nov. 24, 2001 (DE) ..... 101 57 750

(51) Int. Cl.[7] ..... H01F 7/13
(52) U.S. Cl. ..... 335/274; 335/78
(58) Field of Search ..... 335/78–86, 274

(56) References Cited

U.S. PATENT DOCUMENTS 4,684,910 A * 8/1987 Dittmann et al. ..... 335/274
5,065,127 A 11/1991 Mitschik et al. ..... 335/270
5,534,834 A 7/1996 Hendel ..... 2335/78
5,903,200 A 5/1999 Ogawa et al. ..... 355/78

FOREIGN PATENT DOCUMENTS

| | | | |
|---|---|---|---|
| DE | 70 33 403 U | 12/1970 | |
| DE | 30 02 029 A1 | 7/1981 | ..... H01H/50/26 |
| DE | 19920742 A1 | 12/2000 | ..... H01H/50/18 |
| EP | 0 203 496 A2 | 12/1986 | ..... H01H/50/18 |
| EP | 0 480 908 B1 | 7/1996 | ..... H01H/50/18 |

OTHER PUBLICATIONS

European Search Report 9/2002.

* cited by examiner

*Primary Examiner*—Ramon M. Barrera

(57) ABSTRACT

An armature for a switching relay having an armature plate and an armature spring. The armature plate is pivotally mounted on the switching relay between an open and closed position. The armature spring is attached to the switching relay by a suspension and has a spring contact region connected to the armature plate. A first web is attached to the spring contact region, and a tension rod is connected to the first web so that minimal torsional forces are transmitted to the tension rod when the armature plate pivots between the open position and the closed position.

17 Claims, 3 Drawing Sheets

SWITCHING RELAY WITH IMPROVED ARMATURE SPRING

BACKGROUND OF THE INVENTION

The invention relates to a switching relay having an armature spring and, more specifically, to a switching relay having an armature spring with a torsional web region and a tension rod.

DESCRIPTION OF THE PRIOR ART

Electromagnetic switching relays, such as those taught in EP 0 203 496 A2 and EP 0 480 908 B1, are known in a wide variety of embodiments and are used, for example, in automotive engineering. The conventional switching relay has a magnet coil with a magnet core and a yoke. The yoke extends along the outside of the magnet coil from a first end to a second end. At the second end, the yoke has yoke mandrels on which an armature plate pivotally rests. When current is applied to the magnet coil, a closed magnetic field is generated via the magnet core, the yoke, and the armature plate, that is returned to the magnet core. The magnetic field attracts the armature plate toward the magnet core.

A closed or open position is fixed as a function of the position of the armature plate. In the closed position a contact bridge connected to the armature plate connects two electrical terminals to each other. In the open position the contact bridge connected to the armature plate disconnects the two electrical terminals. An armature spring has a tension rod with which a tensile force is transmitted to the armature plate so that the armature plate can be pivoted from the closed position into the open position with low resistance from the armature spring. The tension rod is typically designed as an elongated narrow strip that can be bent with little force to allow for low force movement of the armature plate. The design of the tension rod in the form of an elongated narrow strip, however, requires relatively complex manufacturing and can easily be damaged.

Another example of an electromagnetic switching relay is taught in DE 199 20 742 A1. This switching relay comprises a basic member, a magnet system, and an armature spring. The magnet system has an armature formed with two lever portions that provide the support points for the armature spring. A further support point for the armature spring is located on a fixed portion of the switching relay. The armature may be adjusted by bending the fixed portion of the switching relay to adjust the position of a switching contact in respect to fixed terminals. Owing to unavoidable manufacturing tolerances, the distance between the switching contact and the fixed terminals does not exactly correspond to a desired value, but is subject to manufacturing-related variations. As a result, individual adjustment of the contact spacing is required in each case.

It is therefore desirable to develop an armature spring for a switching relay of mechanically stable and compact construction that transmits a tensile force to an armature plate so that the armature plate can be pivoted from a closed position into an open position with low resistance from the armature spring.

SUMMARY OF THE INVENTION

The invention relates to an armature for a switching relay having an armature plate and an armature spring. The armature plate is pivotally mounted on the switching relay between an open and closed position. The armature spring is attached to the switching relay by a suspension and has a spring contact region connected to the armature plate. A first web is attached to the spring contact region, and a tension rod is connected to the first web so that minimal torsional forces are transmitted to the tension rod when the armature plate pivots between the open position and the closed position.

DETAILED DESCRIPTION OF THE PREFERRED EMBODIMENT

Figure 1:
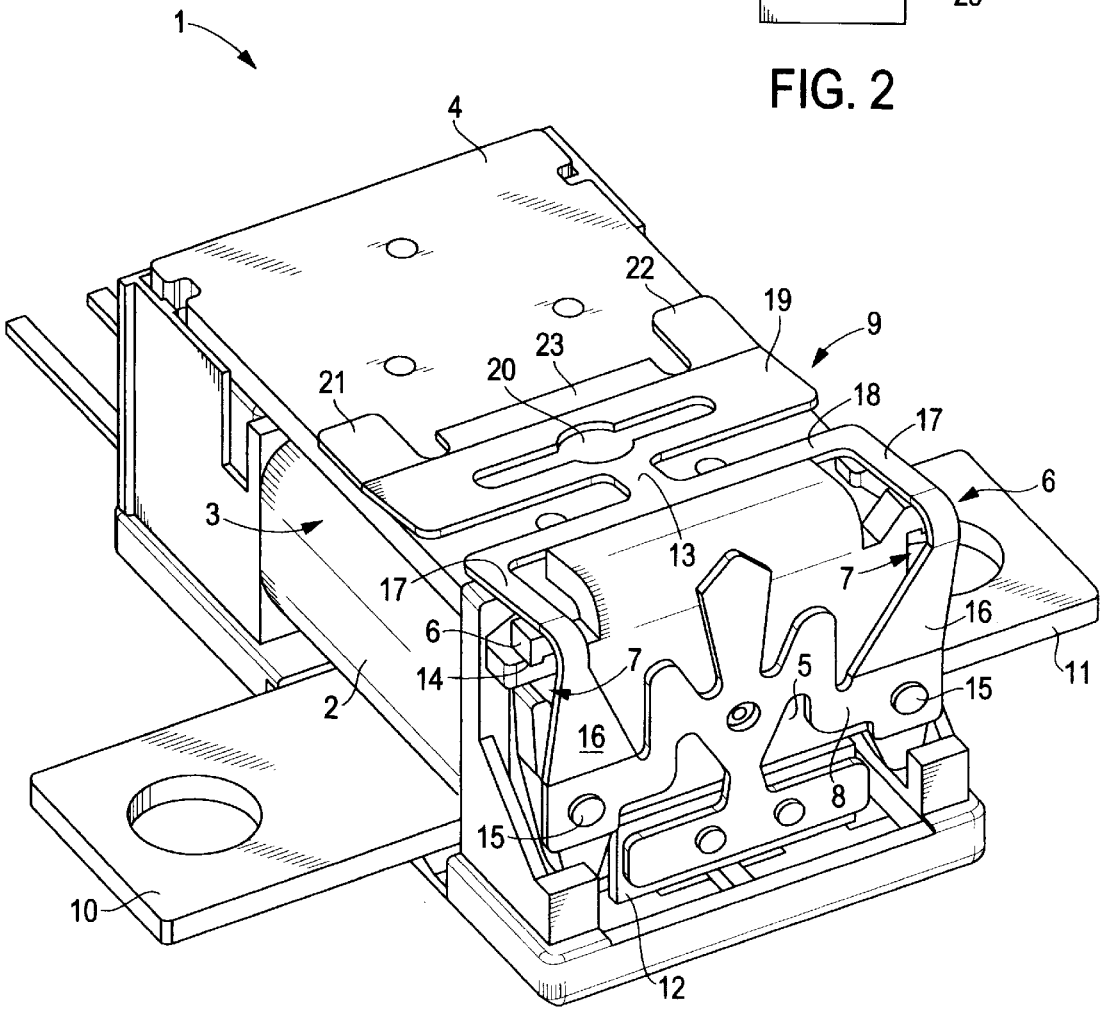
FIG. 1 is a perspective view of a first embodiment of a switching relay with a first embodiment of an armature spring.

FIG. 1 shows a switching relay 1 having a magnet coil 2. The magnet coil 2 has a magnet core 3 that extends from a first open end to a second open end of the magnet coil 2. A yoke plate 4 adjoining the magnet core 3 is formed at a first open end. The yoke plate 4 extends along the upper side of the magnet coil 2 to the second open end of the magnet coil 2. The yoke plate 4 projects beyond the magnet coil 2 in the region of the second open end and has a respective yoke mandrel 6 in two lateral end regions. The yoke mandrel 6 projects into a bearing recess 7 and laterally beyond the yoke plate 4 by a predetermined length. The yoke plate 4 is positioned between the yoke mandrels 6 and behind an armature plate 5. Each bearing recess 7 has a bearing projection 14 formed in the direction of the yoke mandrel 6. The bearing projection 14 serves as a bearing with which the armature plate 5 is pivotally mounted on the yoke mandrels 6. A pivot axis is formed between the two bearing projections 14.

The armature plate 5 extends from the yoke plate 4 along the open end of the magnet coil 2 to a lower edge of the magnet core 3. An armature spring 9 is rigidly connected to an outer side of the armature plate 5 by a spring contact region 8. The armature plate 5 can be connected to the armature spring 9, for example, by rivets 15. A contact bridge 12 is connected to the armature spring 9 substantially adjacent to two terminals 10, 11. In the selected embodiment, the spring contact region 8 of the armature spring 9 is formed via two laterally formed, trapezoidal sections 16 upward into the region of the yoke plate 4. The trapezoidal sections 16 taper upwardly and pass into connecting webs 17. The connecting webs 17 are formed via a bend over an upper side of the yoke plate 4 into end regions of a torsional web 18. The torsional web 18 is preferably arranged parallel to the alignment of the armature plate 5 and is designed as a narrow web, preferably over the entire width of the yoke plate 4. The torsional web 18 is connected centrally at a second lateral edge to a tension rod 13. The tension rod 13 is designed in the form of a web, preferably aligned perpendicularly to the pivot axis of the armature plate 5.

The tension rod 13 is connected to a first lateral edge of a terminal plate 19. The torsional web 18 and the terminal plate 19 extend transversely over the entire width of the yoke plate 4. The terminal plate 19 is substantially rectangular in design. The terminal plate 19 has an elongated central recess 20 arranged substantially perpendicular to the tension rod 13. At a second lateral edge the terminal plate 19 has lateral end regions having first, second and third terminal lugs 21, 22, 23, respectively. The third lug 23 is formed between the first and second terminal lugs 21, 22. The first and second terminal lugs 21, 22 have a substantially rectangular shape and are aligned perpendicular to the transverse direction of the terminal plate 19. The third lug 23 is considerably smaller and wider in design and extends substantially over the entire length of the second lateral edge between the first and second terminal lugs 21, 22. The first and second terminal lugs 21, 22 are rigidly connected to the upper side of the yoke plate 4 via a mechanical connection. The third lug 23 rests on the surface of the yoke plate 4 and stabilises the armature spring 9. The terminal plate 19 is aligned at a predetermined angle to the upper side of the yoke 4.

The operation of the first embodiment of the switching relay 1 will now be described in greater detail with reference to FIG. 1. Depending on the embodiment of the switching relay 1, when current flows through the magnet coil 2, a magnetic field is generated opposed to the magnet core 3 and a permanent magnet (not shown) to cancel the effect of the permanent magnet (not shown). The armature plate 5 is tilted away from the magnet core 3 by the tensile stress of the armature spring 9 to an open position. In the open position, the contact bridge 12 is raised from the first and second terminals 10, 11 to electrically isolate the terminals 10, 11 from one another. During the tilting process, the armature plate 5 pivots about the fixed axis formed by mounting the armature plate 5 on the yoke mandrels 6. When the current through the magnet coil 2 is cancelled, the armature plate 5 is pulled onto the magnet core 3 and into a closed position owing to the magnetic field of the permanent magnet (not shown). When the armature plate 5 is in the closed position the contact bridge 12 contacts the first and second terminals 10, 11 and produces an electrical connection between the first and second terminals 10, 11.

The mechanical torque against the magnetic attraction is applied in both cases by the armature spring 9 to the armature plate 5 which is biased by a tensile stress. As a torque is introduced into the armature spring 9 during pivoting of the armature plate 5 in the direction of the introduced tensile stress, it is advantageous to form torsional regions in the armature spring 9. The formation of the torsional web 18 in the armature spring 9 affords the advantage that minimal torsional forces are transmitted to the tension rod 13 during a pivoting process of the armature plate 5 from the open position to the closed position or vice versa. During pivoting from the closed position into the open position the lower region of the armature plate 5 moves forward away from the switching relay 1. As a result the connecting webs 17 are simultaneously raised upward in the region of the bend. Rotational forces are consequently introduced into the end regions of the torsional web 18. As the torsional web 18 is relatively narrow in design and the distance between the terminal of the tension rod 13 and the terminals of the connecting webs 17 is relatively large, the rotational forces are substantially absorbed by the torsional web 18. The torsional web 18 is rotated per se with respect to its longitudinal axis between the terminal of the tension rod 13 and the terminals of the connecting webs 17. As the torsional web 18 can be rotated in its longitudinal axis without great force, the armature plate 5 can pivot without substantial counterforces from the open position into the closed position and vice versa. Despite the arrangement of the torsional web 18 sufficient transmission of a tensile stress via the armature spring 9 to the armature plate 5 is possible. To this end the torsional web 18 has a thickness such that lateral bending of the torsional web 18 rarely occurs. The tensile stress is transmitted between the terminal region of the terminal plate 19 via the terminal plate 19, the tension rod 13, the torsional web 18, the connecting webs 17 and the trapezoidal sections 16 to the armature plate 5. The use of the tension rod 13 ensures that an adequate elastic tensile force acts on the armature plate 5 leading to pivoting of the armature plate 5 from the closed position into the open position or vice versa if no magnetic forces act on the armature plate 5.

In a simple variation of the first embodiment the terminal plate 19 can also be designed without the receiving aperture 20. The receiving aperture 20 preferably has an enlarged region in the region in which the tension rod region 13 passes to the terminal plate 19. The elasticity of the terminal plate 19 is increased owing to the formation of the receiving aperture 20. The elasticity of the armature spring 9 is hereby further increased with respect to the tensile stress. Therefore, the armature spring 9 can be designed so as to be shorter overall to obtain the same tensile stress.

A fundamental advantage of the armature spring 9 consists in coupling a tension rod 13 and a torsional region 18 in series. Owing to the formation of the two different regions precise adjustment of the tensile stress can be made and, in addition, it can be ensured that torsional forces are absorbed by the torsional region 18 without great resistance. Therefore, the force required to pivot the armature plate 5 is reduced. Increased dynamics to move the armature plate 5 are thus made possible, even though the tensile stress can be relatively high in design leading to improved overall switching dynamics of the switching relay 1.

Precise dimensioning of the tension rod 13 is possible, and thus, precise adjustment of the tensile stress allowed owing to the separate construction of the tension rod 13. Precise adjustment of the torsional counterforces is also possible owing to the separate construction of the torsional region 18. As a result the tension rod 13 can be considerably wider and shorter in design because the rotational movement of the armature plate is taken up by the torsional region 18. An efficient and compact design of the armature spring 9 is possible as a result of the construction of the torsional region 18 in the form of a torsional web 18 aligned parallel to the armature plate 5. In a simple embodiment of the armature spring the torsional web 18 is connected only via a connecting web 17 to the spring contact region 8.

Figure 2:
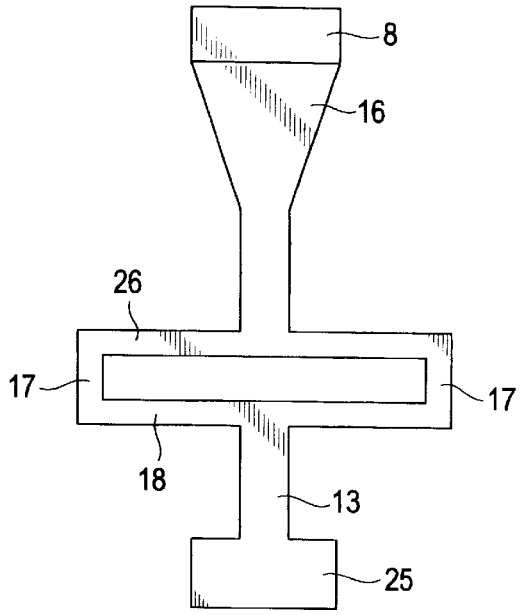
FIG. 2 is a plan view of a second embodiment of the armature spring.

FIG. 2 is a schematic diagram showing a second embodiment of the armature spring 9. The second embodiment of the armature spring 9 has a fastening region 25 with which the armature spring 9 is rigidly connected to the switching relay 1, preferably to the yoke plate 4. A fastening region 25 passes into a first tension rod 13 constructed in the form of a short, relatively wide web. The first tension rod 13 opens centrally into a torsional web 18. Two connecting webs 17 are formed in end regions of the torsional web 18 and are connected to end regions of a second torsional web 26. The second torsional web 26 is preferably designed in accordance with the torsional web 18. The second torsional web 26 is connected centrally to a laterally formed trapezoidal section 16. A spring contact region 8 is connected to the trapezoidal section 16 and is rigidly connected to the armature plate 5.

In FIG. 2, the bend of the terminal of the spring contact region 8 is not shown. The terminal piece is formed in accordance with the embodiment of FIG. 1, starting from an upper side of the yoke plate 4 in the form of a virtually 90° bend downwards to the outer side of the armature plate 5 in which the spring contact region 8 is rigidly connected to the armature plate 5. The embodiment of FIG. 2 has increased torsional elasticity as two torsional webs 18, 26 are connected in series. The arrangement of two torsional webs 18, 26 connected in series reduces the counterforce, generated during pivoting of the armature plate 5 from the closed position into the open position or vice versa owing to the armature spring 9. Increased dynamics are, therefore, possible during pivoting of the armature plate 5.

Figure 3:
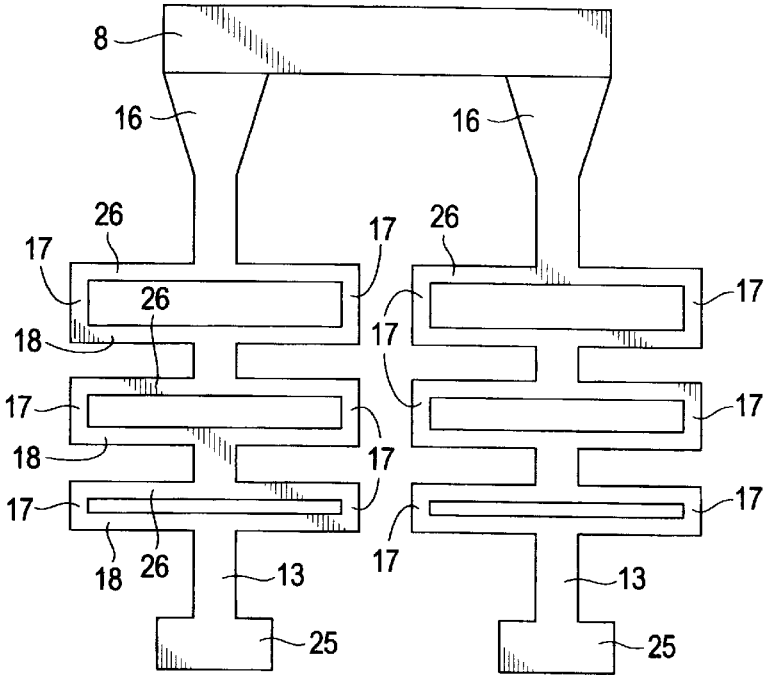
FIG. 3 is a plan view of a third embodiment of the armature spring.

FIG. 3 shows a third embodiment of the armature spring 9 in which a plurality of torsional web pairs 18, 26 are connected to one another in series. The two respective torsional web pairs 18, 26 are connected to one another via a tension rod 13. Preferably, the plurality of torsional web pairs 18, 26 are provided in parallel for the formation of an armature spring 9 in addition to the plurality of torsional web pairs 18, 26 in series. In FIG. 3 two identically constructed armature springs 9 are connected in parallel and connected to a single spring contact region 8. The bend of the terminal regions, formed between the spring contact region 8 and the torsional webs 18, 26, are not explicitly shown in the figures.

A simple method for adjusting modular elasticity or tensile stress is possible owing to the modular construction of the armature spring 9 in accordance with FIG. 3. The embodiment of FIG. 3 affords the advantage that the elasticity of the armature spring 9 can be individually adjusted owing to the arrangement of the torsional web pairs 18, 26. For example, the torsional stiffness and therefore the counterforce against pivoting of the armature plate 5 can be adjusted in stages owing to the series connection of the plurality of torsional webs or torsional web pairs 18, 26. The parallel arrangement in accordance with FIG. 3 is also possible in order to fix spring properties of the armature spring 9 in a modular and therefore staged fashion.

The invention has been described by an example of an armature spring 9 in which the tension rod 13 is aligned substantially perpendicular to the torsional web 18, and the connecting webs 17 are arranged in the end regions of the torsional web 18. Depending on the embodiment, angles differing from 90° can also be formed between the tension rod 13 and the torsional web 18, and the torsional web 18 and the connecting webs 17. The terminal region between the torsional web 18 and the spring contact region 8 can also be designed as a spring contact region. It is also possible to connect the connecting webs 17 to the torsional web 18 further inward, closer to the tension rod 13.

Figure 4:
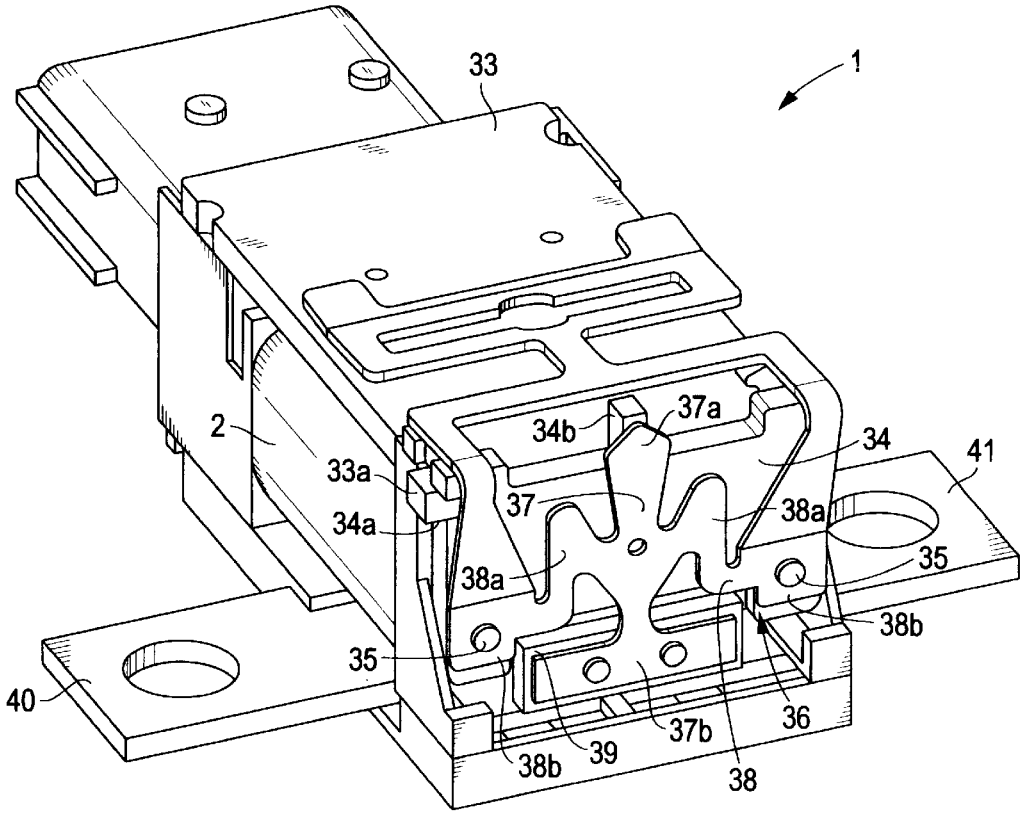
FIG. 4 is a perspective view of a second embodiment of an electromagnetic switching relay shown without a housing and with a first embodiment of a spring contact region.

FIG. 4 shows a perspective view of a second embodiment of the electromagnetic switching relay 1. The switching relay 1 has a magnet coil 2 having a magnet core (not shown) that rests on a portion projecting from the magnet coil 2 on a permanent magnet (not shown). A yoke 33 rests on the magnet coil 2 and is arranged above the magnet coil 2. An armature 34 is arranged at a leading end of the magnet coil 2 opposing the permanent magnet (not shown). Two upper lateral edge regions have bearing recesses 34*a* in which a respective yoke mandrel 33*a* of the yoke 33 is arranged such that the armature 34 is mounted on the yoke mandrels 33*a* and is supported on the leading end of the magnet coil 2.

The armature 34 is rigidly connected via riveted joints 35 to a spring contact region 36 formed as a cruciform leaf spring from two integrally shaped legs 37, 38 that intersect substantially centrally. The first leg 37 of the spring contact region 36 has a first free end 37*a* that adjoins an armature tongue 34*b* of the armature 34 and a second free end 37*b* that carries a contact bridge 39 for contacting two terminals 40, 41. The second leg 38, crossing the first leg 37 substantially centrally, has two elastic spring arms 38*a* connected to the armature 34 via the riveted joint 35 at free ends 38*b*. The spring contact region 36 presses the contact bridge 39 arranged at the second free end 37*b* of the first leg 37 onto contact faces of the terminals 40, 41 as a function of the position of the armature 34.

The operation of the second embodiment of the switching relay 1 will now be described in greater detail with reference to FIG. 4. In the rest position the armature 34 is pulled by the permanent magnet (not shown) in the direction of the magnet coil 2 so that the spring contact region 36 is also pulled in the direction of the magnet coil 2. In the rest position, the contact bridge 39 adjoins the contact faces of the terminals 40, 41 to produce an electrical connection between the first terminal 40 and the second terminal 41. When the magnet coil 2 is supplied with a current, a magnetic field is generated that compensates for the permanent magnetic retaining force of the armature 34. The armature 34 is, therefore, no longer pulled by a magnetic field toward the magnet core (not shown) and the contact faces of the terminals 40, 41 but is pulled away from the magnet core (not shown) by the spring contact region 36. Owing to this tilting movement the lower region of the armature 34 and, therefore, the second free end 37*b* of the first leg 37 of the spring contact region 36 carrying the contact bridge 39 also pivots away from the magnet core (not shown) disconnecting the electric connection between the contact bridge 39 and the terminals 40, 41. The armature 34 tilts about the axis formed by the upper side of the yoke 33, because the armature 34 rests on the yoke mandrels 33*a*.

The spring arms 38*a* of the second leg 38 of the spring contact region 36 pointing outward substantially from the centre of the first leg 37 are elastic and advantageously designed with low torsional stiffness so this region of the spring contact region 36 may be easily rotated in the event of one-sided loading owing to the resulting flexibility of the spring arms 38*a*.

Figure 5:
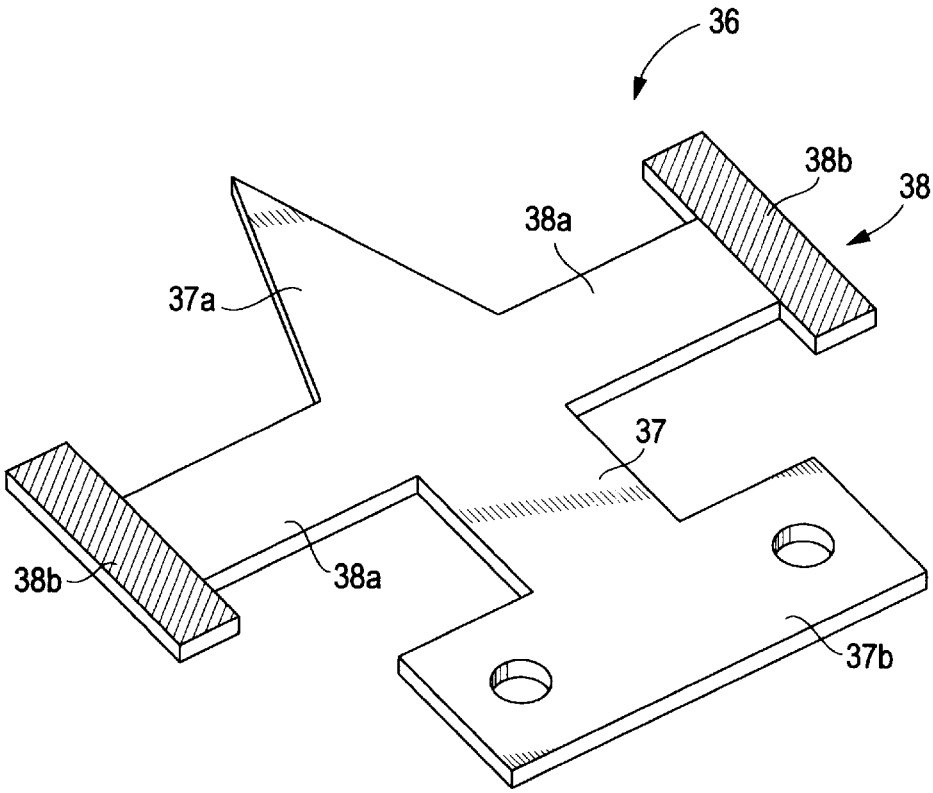
FIG. 5 is a perspective view of a second embodiment of the spring contact region.

FIG. 5 shows a second embodiment of the spring contact region 36. In the second embodiment of the spring contact region 36, the spring arms 38*a* of the second leg 38 point substantially at right angles away from the first leg 37. In this simple design which can be produced by punching, the elasticity and torsional stiffness of the spring arms 38*a* may be influenced by the material thickness and the width of the spring arms 38*a*.

Figure 6:
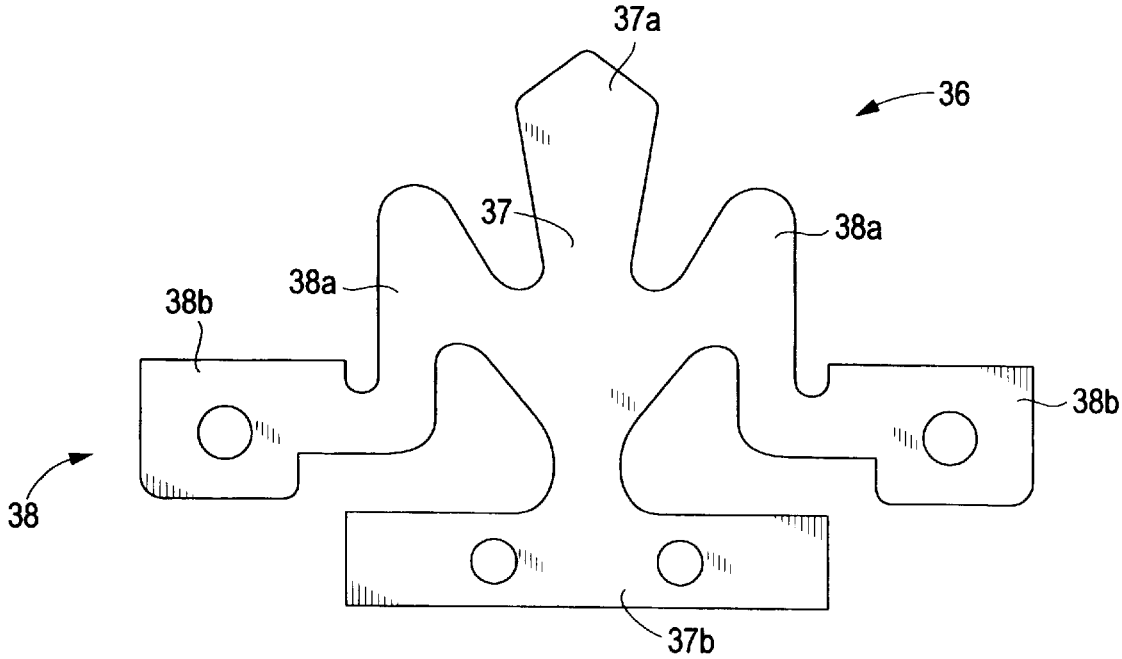
FIG. 6 is a plan view of a third embodiment of the spring contact region.

FIG. 6 shows a third embodiment of the spring contact region 36. The third embodiment of the spring contact region 36 is a somewhat more complex embodiment in that the spring arms 38*a* of the second leg 38 extend in a undulating manner away from the first leg 37. This design allows flexible spring arms 38*a* to be produced on a spring contact region 36 with high spring contact region stiffness.

The described designs of the spring contact regions 36 allow production of a spring contact region 36 substantially with the properties of a hinge, in a very small space and using the manufacturing methods, such as riveting and punching, conventional in relay engineering, the torsional and extra-way stiffness of the spring contact region 36 being independently adjustable. The bridge contact 39 driven by the armature 34 can uniformly distribute the contact force available in the extra way to two contacts with the given spring contour of the spring contact region 36.

We claim:

1. An armature for a switching relay comprising:

an armature plate pivotally mounted on the switching relay between an open and closed position;

an armature spring attached to the switching relay by a suspension and having a spring contact region connected to the armature plate;

a first web attached to the spring contact region; and a tension rod connected to the first web so that minimal torsional forces are transmitted to the tension rod when the armature plate pivots between the open position and the closed position.

2. The armature of claim 1, wherein the first web is positioned parallel to the armature plate.

3. The armature of claim 1, wherein the tension rod is centrally connected to a lateral edge of the first web.

4. The armature of claim 1, wherein the tension rod is positioned perpendicular to the pivot axis of the armature plate.

5. The armature of claim 1, wherein the first web extends over the entire width of the switching relay.

6. The armature of claim 1, wherein the first web is connected by connecting web strips to the spring contact region.

7. The armature of claim 1, wherein the armature spring is attached to the switching relay by a terminal plate having an elongated recess.

8. The armature of claim 7, wherein the tension rod is connected to a first lateral edge of the terminal plate.

9. The armature of claim 8, wherein the terminal plate has a second lateral edge having a first terminal lug and a second terminal lug rigidly connected to the switching relay and a third terminal lug extending between the first terminal lug and the second terminal lug that rests on the switching relay.

10. The armature of claim 1, wherein the armature spring is formed as a cruciform leaf spring having two elastic spring arms extending from a centrally formed leg.

11. The armature of claim 10, wherein the elastic spring arms have a low flexural strength and torsional stiffness.

12. The armature of claim 10, wherein the elastic spring arms are formed perpendicular to the leg.

13. The armature of claim 10, wherein the elastic spring arms extend in an undulating manner away from the leg.

14. The armature of claim 10, wherein the leg has a free end attached to the armature plate.

15. The armature of claim 1, further comprising a second web positioned parallel to the first web and connected to the first web by a connecting web to form a first web pair.

16. The armature of claim 15, further comprising a second web pair connected to the first web pair in series.

17. The armature of claim 15, further comprising a second web pair arranged parallel to the first web pair.

* * * * *